ANTICORROSIVE OVERLAP-COATED STEEL MATERIAL

BACKGROUND OF THE INVENTION

1. Field of the Invention

The present invention relates to improvements in the anticorrosion of an iron or steel material coated with an electroplated layer of an Sn base-Zn alloy.

2. Description of the Prior Art

Such anticorrosive coatings applied to such iron and steel materials as plates, pipes, bars or wires as meet respective requirements have been studied and developed. A steel material in which an electroplated layer of an Sn base-Zn alloy containing more than 50% by weight tin (this electro-plated layer shall be merely called on alloy or alloy layer hereinafter) is formed on the surface and a chromate-treatment is applied on said alloy layer is recently practiced. However, such alloy layer requires a long time in forming the required layer thickness or, for example, 20 to 25 minutes in forming a layer thickness of 15 to 20 microns making it unavoidable to reduce the productivity. Thus an improvement of the productivity together with a further improvement of the anticorrosion is hoped for today.

SUMMARY OF THE INVENTION

The present invention has reduced the forming time of such electroplated layer and has further improved the anticorrosion.

DETAILED DESCRIPTION OF THE INVENTION

Figure 1:
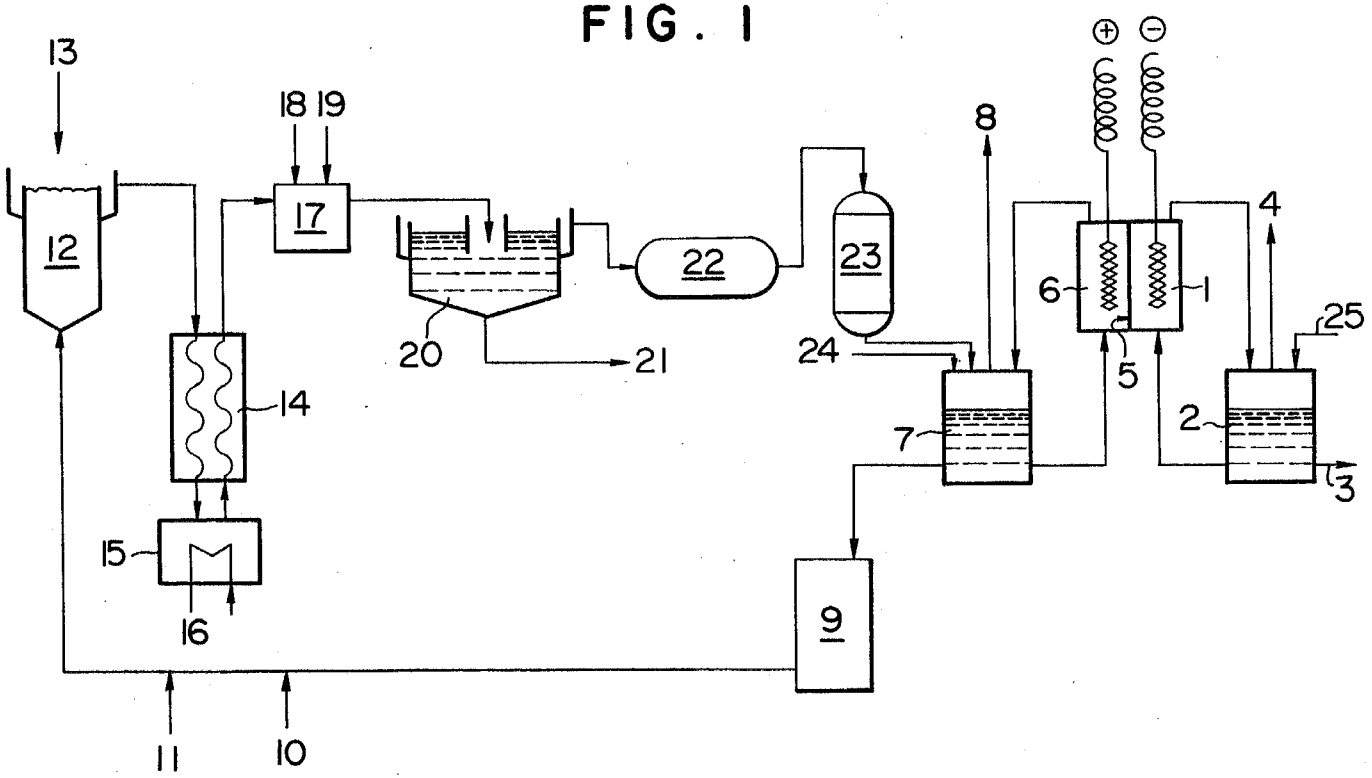

Its subject matter is an anticorrosive overlap-coated steel material made by forming an electroplated layer of an Sn base-Zn alloy directly or through an electroplated layer of zinc on the skin surface of an iron or steel material, then forming an electroplated layer of zinc on said alloy layer and further applying a chromate-treatment on said zinc layer. If the above mentioned conventional overlap-coated steel material is shown by (c) as in the following, the overlap-coated steel materials according to the present invention will be shown as in (a) and (b):

(a) S-alloy-Zn-Cr.

(b)S-Zn-alloy-Zn-Cr.

(c) S-alloy-Cr.

In these indications, S is a steel, the alloy is an electroplated layer of an Sn base-Zn alloy of more than 50% by weight Sn, Zn is an electroplated layer of metallic zinc and Cr is a chromate layer. The conventional product of (c) shows that an electroplated layer of an alloy is applied to a steel skin and a chromate layer is formed on the alloy layer. The product of the present invention of (a) shows that an electroplated layer of an alloy is applied to a steel skin the same as in (c) but an electroplated layer of zinc is applied on the alloy layer and a chromate layer is applied on the zinc layer. The product of the present invention of (b) shows that an electroplated layer of zinc is applied to a steel skin, an electroplated layer of an alloy is applied on said zinc layer and a zinc layer is again electroplated on said alloy layer and a chromate layer is applied on said zinc layer.

The respective coating structures of these overlap-coated steel materials (a), (b) and (c) are shown in turn as follows:

(a') Alloy-Zn-Cr.

(b') Zn-alloy-Zn-Cr.

(c') Alloy-Cr.

The effects obtained by the present invention shall be described in the following.

First of all, from the fact that, if the chromate layer is removed from each of the coating structures (a') and (b') of the products of the present invention and the coating structure (c') of the conventional product, the coating structures (a') and (b') will be able to be considered to have been obtained by replacing a part of the alloy layer of the coating structure (c') with a zinc layer and the electroplated layer of zinc can be electroplated more easily and quickly than the electroplated layer of the alloy, it is understood that the electroplating time of the overlap-coated steel materials (a) and (b) according to the present invention is reduced to be shorter than of the conventional product (c). It is understood that the anticorrosion is remarkably improved because, in the case of the conventional product (c), a chromate-treatment is applied on an alloy layer containing more than 50% by weight tin and therefore the formation of chromate is insufficient, whereas, in the case of the products (a) and (b) of the present invention, a chromate-treatment is applied on a zinc layer and therefore the formation of chromate is sufficient. The differences between the anticorrosions obtained by both of these chromate treatments are shown in the test results of Example 1 and Control 1 mentioned in Table 1 mentioned later. Table 2 shows the differences of the respective samples tested in both examples. Example 1 is of a product (a) of the present invention and Control 1 is of an overlap-coated steel material (d) having the below mentioned coating structure (d'):

(d) Steel-Zn-alloy-chromate.

(d') Zn-alloy-chromate.

If the results mentioned in Table 1 are compared with the coating structures (a') and (d') mentioned in Table 2, as both coating structures (a') and (d') are made by overlapping alloy layers of the same thickness and zinc layers of the same thickness, the cause of the difference of the test results will be naturally understood.

The overlap-coated steel material (b) having the above mentioned coating structure (b') shall be described in the following. This coating structure (b') corresponds to a coating structure obtained by forming an electroplated layer of zinc on a steel skin surface and providing a coating structure (a') of the coated steel material (a) on said zinc layer. The anticorrosion obtained by this coating structure (b') is not expected to have any particular effect from the coating structures (a') and (d') mentioned in Table 2 and the test results mentioned in Table 1 but is far higher than of the coated steel material (a) of the coating structure (a'). This anticorrosion is shown by the comparison of the test results of Examples 2 and 3 mentioned in Table 3. The sample No. 3 obtained in this Example 3 and the sample No. 1 obtained in the above mentioned Example 1 are of the same coating structure (a') but the test results of Example 3 are adopted for the comparison with the test results of Example 2 because, as the total layer thickness of the sample No. 3 is equal to that of the sample No. 2 as mentioned in Table 4 and the total zinc layer thickness of both are equal to each other, they are judged to be adapted to the comparison of the effects.

ELECTROLYSIS OF SODIUM CHLORIDE IN AN ION-EXCHANGE MEMBRANE CELL

This invention relates to a process for electrolysis of sodium chloride in an electrolytic cell divided into an anode chamber and a cathode chamber by a cation exchange membrane and using sodium chloride containing an iron cyanide complex as starting material.

To sodium chloride solids there is frequently added an iron cyanide complex such as potassium ferrocyanide, potassium ferricyanide, sodium ferrocyanide, sodium ferricyanide, etc. in amounts of the order of ten ppm for the purpose of preventing agglomeration of the sodium chloride solids. When electrolysis of a thus treated sodium chloride is carried out, the iron cyanide complex is oxidized by chlorine generated at the anode and is converted to iron ions.

Electrolysis of sodium chloride has conventionally been performed by two processes: the mercury process and the diaphragm process. In the mercury process, sodium chloride containing several ppm of iron cyanide complex may be subjected to electrolysis without forming an amalgam between iron ions formed by oxidation in the anode chamber and mercury, and so no deleterious effect is caused by the electrolysis. On the other hand, in the diaphragm process, when a solution of sodium chloride containing several ppm of iron cyanide complex is subjected to electrolysis, the amount of iron ions formed by oxidation in the anode chamber is as low as 2 ppm or less. While iron ions may be one factor for accelerating clogging of the diaphragm, the influence of other impurities such as calcium, magnesium, and iron ions already present therein is greater, rather than the influence of iron ions derived from the added iron cyanide complex.

However, when electrolysis is conducted in an electrolytic cell divided into an anode chamber and a cathode chamber by a cation exchange membrane by supplying an aqueous sodium chloride solution containing an iron cyanide complex into the anode chamber to obtain chlorine gas from the anode, hydrogen gas from the cathode and caustic soda in the cathode chamber, precipitates of hydroxides are deposited in the cation exchange membrane or on the surface thereof since the cation exchange membrane is far more dense than the asbestos diaphragms used in the diaphragm process. As a result, such phenomena as an increase in electrolysis voltage or breaking of the membrane are very noticeable. For this reason, when a cation exchange membrane is used, it is required that the content of impurities in the aqueous sodium chloride solution which are precipitatable as hydroxides, such as calcium, magnesium, iron ions, etc., be maintained at 0.1 ppm or less.

The present invention is based on the discovery that it is necessary to maintain the content of an iron cyanide complex in an aqueous sodium chloride solution at 0.5 ppm or less when used as an anolyte in an ion-exchange membrane electrolysis cell because the iron cyanide complex contained in the aqueous solution is converted by oxidation to iron ions when it is fed into the anode chamber thus causing an increase in electrolysis voltage.

According to the present invention there is provided a process for electrolysis of sodium chloride containing an iron cyanide complex in an electrolytic cell divided into an anode chamber and a cathode chamber by a cation exchange membrane, wherein said sodium chloride is fed to the anode chamber as a solution having an iron cyanide complex content of not more than 0.5 ppm.

In the process of the present invention, it is only required to reduce the content of the iron cyanide complex in an aqueous sodium chloride solution to not more than 0.5 ppm (the content ppm being based on the weight of solution in the specification and claims unless otherwise noted). For this purpose, there may be employed various processes, for example, removal by use of an anion exchange resin and removal in the form of precipitates. As anion exchange resins, there may be employed strongly basic anion exchange resins having quaternary ammonium groups as anion exchange groups, but it is preferred to use weakly basic anion exchange resins having primary amines, secondary amines or tertiary amines as anion exchange groups in the chlorine form. As chemical reagents for forming precipitates, there may be employed any compound capable of forming a hardly soluble salt with an iron cyanide complex. For example, ferric chloride, copper chloride and zinc chloride may preferably be used.

The present inventors have also found as the result of extensive studies that is is economically more advantageous to remove iron cyanide complex after converting it to iron ions than to remove it in the form of an iron cyanide complex and also that there is no increase in electrolysis voltage when the former method is applied.

For reducing the content of impurities such as calcium, magnesium or iron ions in an aqueous sodium chloride solution to 0.1 ppm or less, it is preferred to perform purification by use of a chelate resin tower. Of course, when there is employed sodium chloride with a high content of such impurities, it is also possible to add sodium carbonate or caustic soda for precipitation of calcium carbonate, magnesium hydroxide or iron hydroxide prior to purification in a chelate resin tower.

When oxidative decomposition of iron cyanide complex to iron ions is carried out prior to the abovementioned purification, the resultant iron ions can also be removed at the same time in the purification step for removing the impurities such as calcium, magnesium, and iron ions or others, to great advantage.

As oxidizing agents for oxidative decomposition of an iron cyanide complex, there may be used any oxidizing agent generally known in the art, including for example chlorine, sodium hypochlorite, hydrogen peroxide, sodium chlorate, potassium chromate and potassium permanganate. Among them, chlorine and/or sodium hypochlorite are preferably used. These oxidizing agents may be added to an aqueous sodium chloride solution containing an iron cyanide complex. However, when a cation exchange membrane is employed in a sodium chloride electrolysis, a part of the anolyte containing chlorine and sodium hypochlorite with a decreased sodium concentration is taken out and further sodium chloride is dissolved therein. Preferably there is used an anolyte having chlorine gas dissolved therein, the content of chlorine gas being controlled so that an aqueous sodium chloride solution containing iron cyanide complex preferably contains 30 to 200 ppm of dissolved chlorine. While an amount in excess of 200 ppm can be used, it is not preferred on account of the strong chlorine odor which occurs when dissolving the sodium chloride. Thus, since an anolyte generally contains several hundred ppm of chlorine, it is desired to reduce the chlorine content to not higher than 200 ppm and not lower than 30 ppm before use.

Turning now to the temperature for oxidative decomposition, when chlorine and/or sodium hypochlorite are used as oxidizing agent, there occurs no practically sufficient decomposition at a temperature lower than 60° C. except for conversion of ferrocyanide to ferricyanide. Accordingly, it is necessary to maintain the temperature at 60° C. or higher. At a temperature of 60° C. or higher, the iron cyanide complex will undergo decomposition to iron ions more rapidly with increasing temperature. A temperature exceeding 150° C., however, it not desirable because the process equipment is then possibly liable to excessive corrosion. More preferably, the temperature is within the range from 90° C. to 110° C. Within this temperature range, the residence time necessary for the oxidative decomposition may be within one hour. The electrolysis temperature is generally about 90° C. for producing caustic soda by use of a cation exchange membrane.

Into an anode chamber is generally supplied a substantially saturated aqueous sodium chloride solution, which after being consumed in the anode chamber to a concentration of approximately half of the original sodium chloride concentration is then discharged. This dilute sodium chloride solution is recycled for re-use for dissolving further sodium chloride. As sodium ions migrate from the anode chamber through a cation exchange membrane to the cathode chamber in an electrolytic cell, about 90 g of water per one mol of sodium ions generally passes through the membrane together with the sodium ions. Corresponding to such migration, it is usually the practice to supplement about $\frac{1}{3}$ of the dilute sodium chloride solution withdrawn from the anode chamber at about 90° C. with water at room temperature, followed by dissolution of sodium chloride at room temperature therein. As the result, the temperature of the substantially saturated aqueous sodium chloride solution after dissolution of the sodium chloride containing the iron cyanide complex becomes generally lower than 60° C. Accordingly, for effecting decomposition of the iron cyanide complex it is generally required, in addition to dissolution of chlorine gas, to heat the solution to 60° C. or higher. On the other hand, an electrolytic cell is in itself exothermic. Hence, for continuing electrolysis at a constant temperature, it is required to cool the cell constantly by some means. Therefore, it is not desirable to supply the sodium chloride solution to the electrolytic cell at a high temperature as it is after having decomposed an iron cyanide complex at 60° C. or higher. Accordingly, it is preferred to effect heat exchange between the aqueous sodium chloride solution containing the iron cyanide complex and the aqueous sodium chloride solution after being subjected to oxidative decomposition of the iron cyanide complex at 60° C. or higher. By this heat exchange, the amount of steam necessary for oxidative decomposition can be reduced.

As cation exchange membranes, there may be used those having sulfonic acid ion-exchange groups, but with formation of a liquid such as caustic soda in the cathode chamber, hydroxyl ions are liable to migrate into the anode chamber, whereby the current efficiency can hardly be increased. For this reason, it is preferred to use cation exchange membranes having weakly acidic ion exchange groups such as carboxylic acid groups, sulfonamide groups, phosphoric acid groups or others, or cation exchange groups having both sulfonic acid groups and these weakly acidic groups in layers. Typical examples of such cation exchange membranes are disclosed by, for example, Japanese published unexamined patent application Nos. 24176/1977, 44360/1973, 66488/1975 and 82684/1978.

Especially with these cation exchange membranes having weakly acidic groups, when iron ions are present in the anolyte, iron ions accumulate on the membrane surface or internally of the membrane to increase the voltage. Thus, removal of iron ions and iron cyanide complexes is very important.

Figure 2:
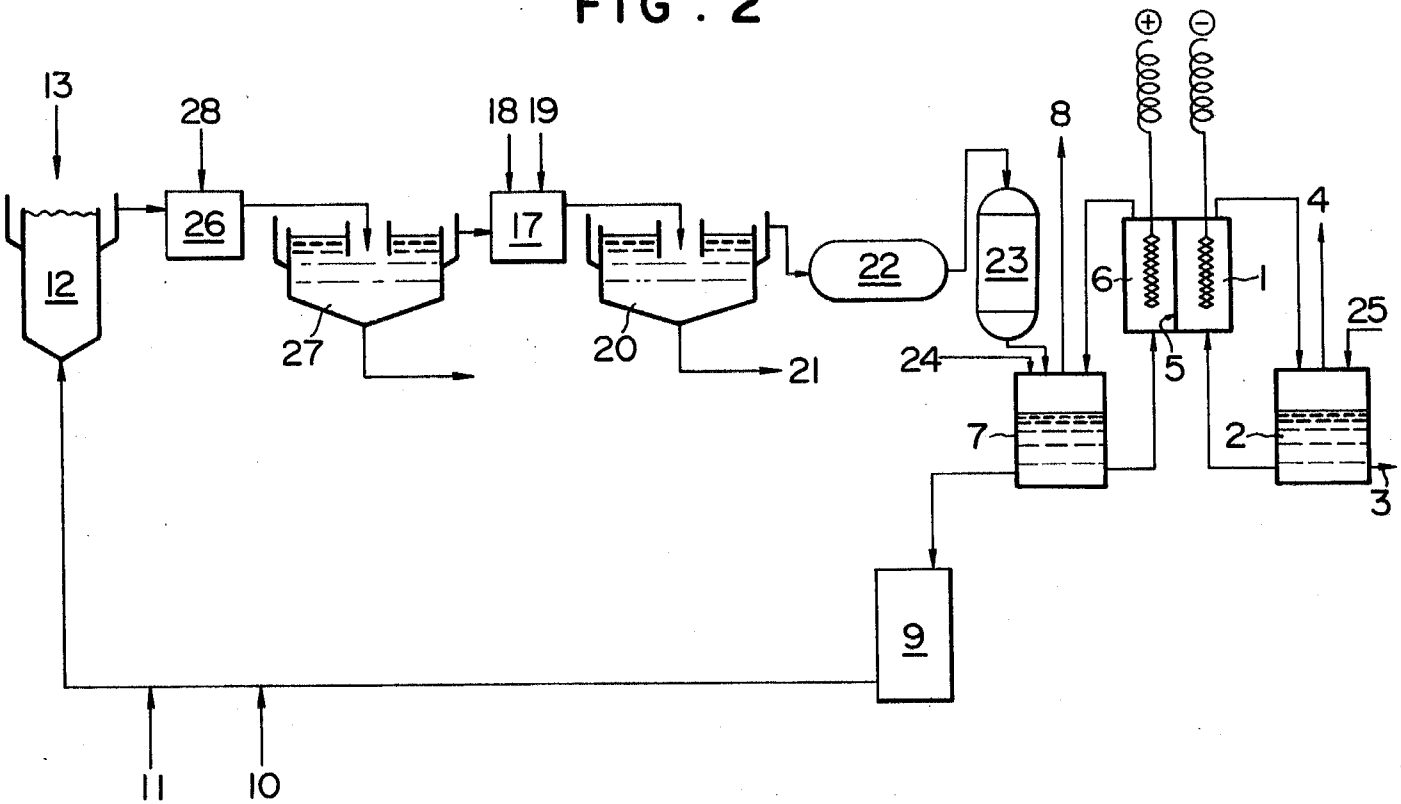
Figure 3:
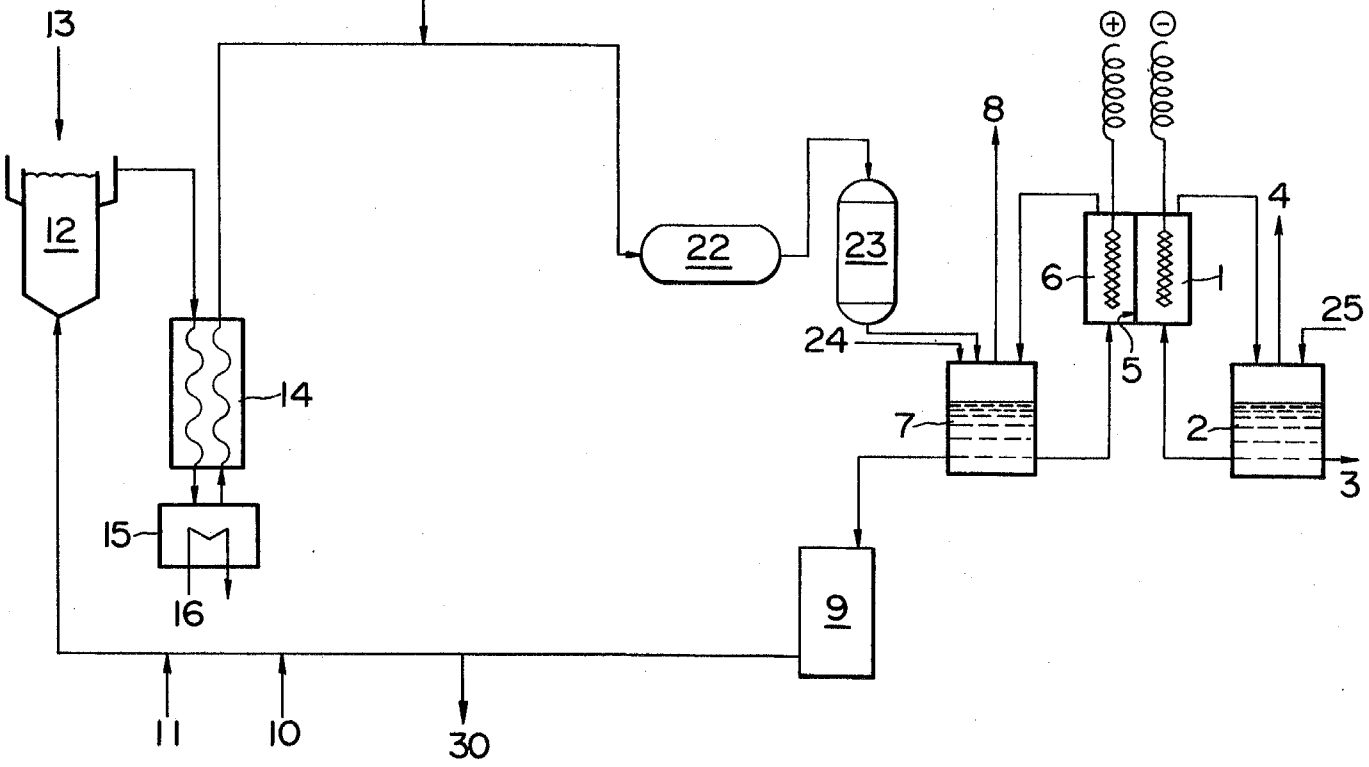

The present invention will now be described in more detail making reference to the accompanying drawings, in which FIGS. 1 to 3 are each a flow sheet of a typical apparatus in which the process of the present invention can be applied.

Referring to FIG. 1, an electrolytic cell has a cathode chamber 1 and a catholyte tank 2, an aqueous caustic soda solution being circulated between chamber 1 and tank 2. In the catholyte tank 2, the catholyte is separated into aqueous caustic soda solution which is discharged from line 3 and hydrogen gas which is discharged from line 4. A cation exchange membrane 5 divides the cathode chamber of the electrolytic cell from an anode chamber 6. Anolyte is circulated between chamber 6 and tank 7. Chlorine gas separated from the anolyte in tank 7 is withdrawn from line 8 and the aqueous sodium chloride solution with decreased concentration is passed to a dechlorination tower 9. Supplementary water is added from line 10 to dilute aqueous sodium chloride solution taken from the tower 9 and having a dissolved chlorine gas content of 30 to 200 ppm. The diluted solution is then fed to a sodium chloride dissolving tank 12. Optionally caustic soda is previously added from line 11 to an extent which prevents precipitation of magnesium hydroxide in the tank 12, namely at pH 9 or lower.

From line 13 sodium chloride crystals containing as anti-caking agent potassium iron cyanides, etc. is added to the dissolving tank 12. The saturated aqueous sodium chloride solution formed in tank 12 is pre-heated by passing through a heat-exchanger 14 and further heated in an oxidative decomposition tank 15° to 60° C. or higher with steam introduced from line 16. After a residence time in tank 15 sufficient for oxidative decomposition, the hot solution is returned to the heat-exchanger 14 to pre-heat incoming solution from tank 12. After being cooled by use as a heat source in heat-exchanger 14, the solution is passed to a reaction vessel 17 where it is treated with additives such as sodium carbonate, caustic soda, etc. supplied from line 18. If necessary, barium carbonate, sodium sulfite or precipitation accelerators are added from line 19.

The treated solution is then passed to a thickener 20, wherein the iron ions from the oxidatively decomposed iron cyanide complex are discharged from line 21 as iron hydroxides, together with magnesium hydroxide, calcium carbonate, etc. The treated solution is then passed successively through a filter 22 and a chelate resin tower 23 wherein calcium ions, magnesium ions, iron ions or others remaining dissolved in the aqueous sodium chloride solution are removed to reduce their contents to 0.1 ppm, respectively.

The thus purified, substantially saturated aqueous sodium chloride solution is fed into the anolyte tank 7.

Hydrochloric acid is supplied to anolyte tank 7 from line 24 in order to maintain the pH in anolyte tank 7 at a constant value. The caustic soda concentration in the cathode chamber 1 is controlled when necessary by addition of water to the catholyte tank 3 from line 25.

EXAMPLE 1

In an apparatus in accordance with the flow sheet shown in FIG. 1, the anolyte tank 7 is charged from tower 23 with an aqueous sodium chloride solution having a concentration of 300 to 310 g NaCl/liter and with hydrochloric acid from line 24. The liquid circulated between tank 7 and anolyte chamber 6 is adjusted to a sodium chloride concentration of 175 g/liter and a pH of about 2. There is also a circulation system between the catholyte tank 2 and the cathode chamber 1, and caustic soda formed is withdrawn through line 3. Water is added from line 25 so that this caustic soda may have a concentration of 21%. The temperature of the circulated solution is controlled at 90° C. A part of the sodium chloride solution circulated is withdrawn from tank 7 to tower 9, and the operation is carried out so that the chlorine concentration in the outlet dilute sodium chloride solution from dechlorination tower 9 may be 30 to 200 ppm. From line 10 is added water and caustic soda is added from line 11 to control the pH in dissolving tank 12.

As the starting sodium chloride introduced from line 13, there is employed sodium chloride containing 12 ppm (based on sodium chloride) of potassium ferrocyanide. In tank 12, the sodium chloride is dissolved to a sodium chloride concentration of 310 g/liter. The concentration of potassium ferrocyanide is found to be 2.2 ppm and the outlet temperature 60° C. Table 1 shows the concentrations of potassium ferricyanide in the sodium chloride solution at the outlet from the oxidative decomposition tank 15 when the oxidative decomposition tank 15 is operated by varying the temperatures at various pH, namely at 60° C., 70° C., 90° C., 110° C. at pH=4, 6, 8 and 10. The chlorine concentration in the sodium chloride solution after dissolution of sodium chloride is found to be 100 ppm and the residence time of the sodium chloride solution in the oxidative decomposition tank is 15 minutes.

Table 1

| pH \ Temperature: | 60° C. | 70° C. | 90° C. | 110° C. |
|---|---|---|---|---|
| 4 | 1.40 | 0.67 | 0.01 | <0.01 |
| 6 | 1.20 | 0.05 | <0.01 | <0.01 |
| 8 | 1.10 | 0.35 | <0.01 | <0.01 |
| 10 | 1.40 | 0.58 | 0.02 | <0.01 |
| | | | (unit: ppm) | |

The above results show that the temperature required for effecting oxidative decomposition of potassium ferrocyanide is 60° C. or higher and the pH is preferably from 5 to 9.

When continuous electrolysis is performed for one month at a current density of 40 A/dm$^2$ using a cation-exchange membrane comprising two layers, a perfluorosulfonic acid layer and a perfluorocarboxylic acid layer (as disclosed by Japanese published unexamined patent application No. 24176/1977), while controlling the oxidative decomposition tank at a temperature of 100° C. and pH=6, the voltage is found to be 3.75 volts, which has been constantly stable.

On the other hand, when the procedure is performed while by-passing the oxidative decomposition tank, the voltage, which is as low as 3.75 volts at start-up, is increased with time up to 4 volts or higher after 3 days, showing a further tendency to increase thereafter.

EXAMPLE 2

In an apparatus similar to that shown in FIG. 1, but having no parts corresponding to 14, 15, 16, 17, 18, 19, 20 and 21, the solution treated in chelate tower 23 is further passed through a tower packed with anion exchange resins and fed to anolyte tank 7 as an aqueous sodium chloride solution with a concentration of 300 to 310 g NaCl/liter. Hydrochloric acid from line 24 is also fed into the anolyte tank 7. The solution is circulated between tank 7 and anode chamber 6 and is adjusted to a sodium chloride concentration of 175 g/liter and a pH of about 2. In the circulation system between the catholyte tank 2 and the cathode chamber 1 caustic soda is withdrawn from line 3 and water is added from line 25 so as to control the caustic soda solution at a concentration of 21% by wt. The temperature of the solution circulated is controlled at 90° C. At part of the sodium chloride solution circulated is withdrawn from tank 7 into tower 9 and the chlorine in the outlet dilute sodium chloride solution is removed in the dechlorination tower 9. Supplementary water is added from line 10 and caustic soda from line 11 in order to control the pH in the dissolving tank 12 at a pH of 7.

As the sodium chloride added from line 13 there is used sodium chloride containing 12 ppm (based on sodium chloride) of potassium ferrocyanide. This is dissolved in tank 12 to give a solution having a sodium chloride concentration of 310 g/liter. The resulting concentration of potassium ferrocyanide is found to be 2.2 ppm and the outlet temperature to be 60° C. Further, the ferrocyanide ion concentration in the aqueous sodium chloride solution coming out from the anion exchange tower is found to be 0.1 ppm or less, while those of calcium ion, magnesium ion and iron ion are 0.1 ppm or less, respectively.

When electrolysis is performed by use of the thus treated aqueous sodium chloride solution under the same conditions as in Example 1, the voltage is found to be 3.75 volts and stable.

EXAMPLE 3

In this Example there is employed an apparatus as shown in the flow-sheet of FIG. 2, in which the parts 14, 15 and 16 of the apparatus shown in FIG. 1 are replaced by a reaction vessel 26 and thickener 27.

The sodium chloride starting material introduced from line 13 is sodium chloride containing 12 ppm of potassium ferrocyanide. The sodium chloride is dissolved in dissolving tank 12 to a sodium chloride concentration of 310 g/liter. The concentration of potassium ferrocyanide is found to be 2.2 ppm, and the outlet temperature 60° C.

Ferric chloride is added from line 28 to control the ferric ion concentration in the reaction vessel 26 to 5 mg/liter. The ferrocyanide ion is separated by precipitation as ferric ferrocyanide in the thickener 27, the concentration of potassium ferrocyanide at the outlet of the thickener 27 being 0.5 ppm. Further, in thickener 20 and chelate resin tower 23, calcium ions, magnesium ions and iron ions are removed to contents of 0.1 ppm or less.

Such a purified aqueous sodium chloride solution and hydrochloric acid are fed from tower 23 and line 24, respectively, into the anolyte tank 7, and the solution circulated between tank 7 and anolyte chamber 6 is adjusted to a sodium chloride concentration of 175 g/liter and a pH of about 2. There is also a circulation system between the catholyte tank 2 and the cathode chamber 1, and from the line 3 is withdrawn the caustic soda which is formed. Water is added from line 25 so as to control this caustic soda at a concentration of 21% by wt. The temperature of the circulated solution is controlled at 90° C.

When the thus treated sodium chloride solution is subjected to electrolysis under the same conditions as described in Example 1, the voltage is found to be stable at 3.75 volts.

EXAMPLE 4

In this example there is employed an apparatus as shown in FIG. 3, in which the same numbers indicate the same parts as in FIGS. 1 and 2. In this apparatus, without effecting any precipitation removal of calcium carbonate, magnesium hydroxide, etc. by addition of sodium carbonate, caustic soda, etc., the aqueous sodium chloride solution coming out from the heat-exchanger 14 is introduced directly into filter 22 and chelate resin tower 23, in which impurities in the aqueous sodium chloride solution such as calcium ions, magnesium ions, or iron ions are reduced to a content of less than 0.1 ppm. During this step, if desired, sodium sulfite and caustic soda may also be added from line 29. The line 30 is a blow-down line provided for maintaining the concentration of sulfate ions in the aqueous sodium chloride solution at a constant value. In this Example, a part of the dilute aqueous sodium chloride solution is subjected to blow-down so as to maintain the sulfate ion concentration in the aqueous sodium chloride solution at 5 g/liter. Other parts are the same as those in Example 1 and have the same numbers.

Continuous electrolysis is performed at a current density of 40 A/dm$^2$, while controlling the chlorine concentration in the aqueous sodium chloride solution after dissolution of sodium chloride at 100 ppm, and the temperature and pH in the oxidative decomposition tank at 100° C. and pH=8, the conditions being otherwise the same as described in Example 1. As the result, the electrolysis voltage is constantly stable at 3.75 volts.

We claim:

1. A process for the electrolysis of sodium chloride in an electrolytic cell divided into an anode chamber and a cathode chamber by a cation exchange membrane, wherein an aqueous solution of sodium chloride containing an iron cyanide complex is purified so as to reduce the content of iron cyanide complex therein to an amount of not greater than 0.5 ppm before said solution is fed to the anode chamber.

2. A process according to claim 1, wherein the content of the iron cyanide complex in the sodium chloride solution is reduced by conversion to iron ions by oxidative decomposition for removal thereof before feeding to the anode chamber.

3. A process according to claim 2, wherein the oxidative decomposition of the iron cyanide complex is conducted, after dissolution of sodium chloride, prior to removal of other impurities.

4. A process according to claim 2 or claim 3, wherein chlorine or sodium hypochlorite is used as the oxidizing agent.

5. A process according to claim 4, wherein the oxidative decomposition is conducted while maintaining a chlorine concentration in the sodium chloride solution of 30 to 200 ppm and a temperature at 60° C. to 150° C.

6. A process according to claim 5, wherein the solution fed into the means wherein said oxidative decomposition is conducted is heat-exchanged with the solution being discharged therefrom. is reduced by treating the solution with an anion-exchange resin before feeding to the anode chamber.

7. A process according to claim 1, wherein the content of the iron cyanide complex in the sodium chloride solution is reduced by treating the solution with a chemical reagent, followed by precipitation separation and/or filtration separation.

8. A process according to claim 7, wherein the chemical reagent is ferric chloride.

9. A process according to claim 1, wherein the content of the iron cyanide complex in the sodium chloride solution is reduced by treating the solution with an anion-exchange resin before feeding to the anode chamber.

10. A process according to any one of claims 2 or 1, wherein at least a part of the ion-exchange groups in the cation exchange membrane are weakly acidic ion-exchange groups.

* * * * *